US008159207B2

(12) United States Patent
Ivanov et al.

(10) Patent No.: US 8,159,207 B2
(45) **Date of Patent: *Apr. 17, 2012**

(54) LOW DROP VOLTAGE REGULATOR WITH INSTANT LOAD REGULATION AND METHOD

(75) Inventors: Vadim V. Ivanov, Tucson, AZ (US); Keith E. Kunz, Bryan, TX (US)

(73) Assignee: Texas Instruments Incorporated, Dallas, TX (US)

( * ) Notice: Subject to any disclaimer, the term of this patent is extended or adjusted under 35 U.S.C. 154(b) by 295 days.

This patent is subject to a terminal disclaimer.

(21) Appl. No.: 12/610,944

(22) Filed: Nov. 2, 2009

(65) Prior Publication Data

US 2010/0045380 A1 Feb. 25, 2010

Related U.S. Application Data

(63) Continuation of application No. 12/008,533, filed on Jan. 11, 2008, now Pat. No. 7,633,280.

(51) Int. Cl.
*G05F 3/16* (2006.01)

(52) U.S. Cl. ..... 323/316

(58) Field of Classification Search ..... 381/120; 330/251, 252, 264, 269, 297, 310, 292; 323/316
See application file for complete search history.

(56) References Cited

U.S. PATENT DOCUMENTS 6,930,551 B2 8/2005 Ivanov et al.
6,933,772 B1 * 8/2005 Banerjee et al. ..... 327/541
7,633,280 B2 * 12/2009 Ivanov et al. ..... 323/316

* cited by examiner

*Primary Examiner* — Shawn Riley
(74) *Attorney, Agent, or Firm* — John J. Patti; Wade J. Brady, III; Frederick J. Telecky, Jr.

(57) ABSTRACT

An LDO regulator (10) produces an output voltage (Vout) by applying the output voltage to a feedback input (6) of a differential input stage (10A) and applying an output (3) of the differential input stage to a gate of a first follower transistor (MP4) having a source coupled to an input (8) of a class AB output stage (10C) which generates the output voltage. Demanded load current is supplied by the output voltage during a dip in its value to a gate of a second follower transistor (MP5) having a gate coupled to the output of the input stage to decrease current in a current mirror (MN5,6) having an output coupled to a current source (I1) and a gate of an amplifying transistor (MN7). This causes the current source to rapidly turn on the amplifying transistor to cause it to rapidly turn on a cascode transistor (MN3), causing it to turn on a pass transistor (MP3) of the output stage.

4 Claims, 3 Drawing Sheets

LOW DROP VOLTAGE REGULATOR WITH INSTANT LOAD REGULATION AND METHOD

CROSS-REFERENCE TO RELATED APPLICATIONS

This application is a continuation of U.S. patent application Ser. No. 12/008,533, filed on Jan. 11, 2008, which is hereby incorporated by reference for all purposes.

BACKGROUND

The present invention relates generally to low-dropout voltage regulators (LDO voltage regulators), and more particularly to LDO voltage regulators which are especially suited to being embedded in various integrated circuit chips that require precise internal load voltage regulation, and yet more particularly to improvements which provide such LDO voltage regulators with high bandwidth and fast response to instant increases (i.e. step increases) in the demanded load current without use of a large, external load bypass capacitor.

Power consumption of various digital logic circuit cells that are manufactured using various modern integrated circuit manufacturing processes can instantly, i.e., within a few picoseconds, vary between zero and a large maximum value, e.g. 5 to 150 milliamperes. At the same time, very precise power supply voltage regulation is required for the digital logic circuit cells.

Existing topologies of voltage regulator circuits do not allow sufficiently fast circuit operation to supply such large instantaneous increases, i.e. steps, in the amount of demanded load current without using large external load bypass capacitors that have capacitances in the microfarad range connected between the output of the LDO voltage regulator and a power supply conductor along with the digital logic circuit cells and the LDO voltage regulator which powers them. Such large load bypass capacitors can not, as a practical matter, be included in an integrated circuit chip. Although small load bypass capacitors having capacitances of up to a few nanofarads have been included in digital logic circuit cells, these small capacitors are incapable of supplying load current steps as large as would typically be needed. Consequently, it has been necessary to use above mentioned external load bypass capacitors.

Use of the external load bypass capacitors is costly because of the relatively high cost of the capacitors themselves, the costs associated with the extra required integrated circuit package lead, and the cost of the additional area of the bonding pad required on the integrated circuit chip in which the digital logic circuit cells and the voltage regulator are formed. Furthermore, and most important, the external load bypass capacitor is separated from the output of the embedded voltage regulator by a signal path and a wire bond connection having a parasitic inductance of roughly 3-5 nanohenrys. The voltage drop across this parasitic inductance during a load current step ordinarily exceeds the load voltage regulation requirements of the digital logic circuit cells. This causes operation of the digital circuitry powered by the embedded voltage regulator to be unreliable.

The closest prior art is believed to include the LDO voltage regulator shown in FIG. 3 of commonly owned U.S. Pat. No. 6,930,551 "Zero Voltage Class AB Minimal Delay Output Stage and Method" issued Aug. 16, 2005 to Ivanov et al. Prior Art FIG. 1 herein shows a schematic diagram of an LDO voltage regulator essentially similar to the one in FIG. 3 of the '551 patent.

In Prior Art FIG. 1, LDO regulator 1 includes a differential input amplifier stage including differentially coupled N-channel input transistors MN1 and MN2. The gate of transistor MN1 is connected to a reference voltage Vref that can be generated by a conventional bandgap circuit. The gate of transistor MN2 is connected to a conductor 6, on which the regulated output voltage Vout of LDO voltage regulator 1 is produced by means of an output stage including P-channel pass transistor MP3 and a N-channel pull-down transistor MN4, a P-channel source follower transistor MP4, and a N-channel cascode transistor MN3. The drain of input transistor MN2 is connected by conductor 3 to the gate of source follower transistor MP4 and to a terminal of a small internal capacitor C0, which provides compensation for the feedback loop that includes input transistor MN1 and source follower transistor MP4. The source and bulk electrodes of source follower transistor MP4 are connected to output conductor 6, which also is connected to the sources of P-channel active load transistors MP1 and MP2 of the differential input stage. The drain of source follower transistor MP4 is connected by conductor 8 to the gate of pull-down transistor MN4. A constant current source 11 producing a current I1 is coupled between $V_{SS}$ and the source of cascode transistor MN3, the drain of which is coupled by conductor 12 to the gate of pass transistor MP3 and one terminal of a pull-up resistor R, the other terminal of which is connected to $V_{DD}$. The gate of cascode transistor MN3 is connected by conductor 18 to the (+) terminal of a constant voltage source 9, the (−) terminal of which is connected to $V_{SS}$. Source follower transistor MP4 is part of a current gain boost feedback loop which in effect increases the output conductance of source follower transistor MP4 and increases the load drive capability of LDO regulator 1. A load 7 is connected between Vout and $V_{SS}$. One terminal of external load bypass capacitor $C_{EXT}$ is coupled by a wire bond to regulated output voltage conductor 6. The wire bond can be represented by its 3-5 nanohenry inductance Lwb. The other terminal of external load bypass capacitor $C_{EXT}$ is also connected by means of a similar wire bond inductance to the $V_{SS}$ conductor on the integrated circuit chip. Load 7 can be represented by a variable current source $I_L$ connected in parallel with a small internal load capacitance $C_{INT}$.

The circuit structure of prior art LDO voltage regulator 1 provides a large achievable small-signal bandwidth for a chosen total current consumption and a chosen integrated circuit manufacturing process, but can not provide a suitably fast large-signal response to a step increase in the current demanded by load 7 connected to the regulated output voltage Vout on conductor 6. This is because the gate voltage of pass transistor MP3, which typically is a very large device having a gate capacitance of roughly 0.5 to 10 picofarads, may need to swing from few hundred millivolts to more than a volt in response to a step increase in the current demanded by load 7, whereas the current available to charge the gate of the pass transistor MP3 during the load current step is limited by the amount of current I1 that can be supplied by current source 11 alone.

Consequently, the amount of current I1 of current source 11 must be substantially increased in order to achieve a correspondingly faster response of LDO voltage regulator 1 to a step increase in the demanded load current, thereby undesirably increasing the power consumption of prior art LDO voltage regulator 1.

Thus, there is an unmet need for LDO voltage regulator circuitry which can provide substantially increased voltage regulator bandwidth without correspondingly increased power consumption.

There also is an unmet need for LDO voltage regulator circuitry which can provide a very fast, large-swing drive signal to the gate of an output transistor of the LDO voltage regulator in response to a step-current increase in the current demanded by a load without substantially increasing the quiescent current of the voltage regulator.

There also is an unmet need for LDO voltage regulator circuitry capable of providing fast regulation response for an increased range of load capacitance.

There also is an unmet need for LDO voltage regulator circuitry capable of providing both fast regulation response and stable operation for an increased range of load capacitance.

SUMMARY

It is an object of the invention to provide a LDO voltage regulator circuitry which can provide substantially increased voltage regulator bandwidth without correspondingly increased power consumption.

It is another object of the invention to provide LDO voltage regulator circuitry which can provide a very fast, large-swing drive signal to the gate of an output transistor of the LDO voltage regulator in response to a step-current increase in the current demanded by a load without substantially increasing the quiescent current of the voltage regulator.

It is another object of the invention to provide LDO voltage regulator circuitry capable of providing fast regulation response for an increased range of load capacitance.

It is another object of the invention to provide LDO voltage regulator circuitry capable of providing both fast regulation response and stable operation for an increased range of load capacitance.

Briefly described, and in accordance with one embodiment, the present invention provides an LDO regulator (10) produces an output voltage (Vout) by applying the output voltage to a feedback input (6) of a differential input stage (10A) and applying an output (3) of the differential input stage to a control electrode of a first follower transistor (MP4) having a first electrode coupled to an input (8) of a class AB output stage (10C) which generates the output voltage. Demanded load current is supplied by the output voltage during a dip in its value to a control electrode of a second follower transistor (MP5) having a control electrode coupled to the output of the input stage to decrease current in a current mirror (MN5,6) having an output coupled to a current source (I1) and a control electrode of an amplifying transistor (MN7). This causes the current source to rapidly turn on the amplifying transistor to cause it to rapidly turn on a cascode transistor (MN3), causing it to turn on a pass transistor (MP3) of the output stage.

In one embodiment, the invention provides voltage regulator circuitry (10) including a differential input stage (10A) having a first input coupled to receive a reference voltage (Vref), a second input coupled to a regulated output conductor (6) of the voltage regulator circuitry (10), and an output (3). An output stage (10C) produces a regulated output voltage (Vout) on the regulated output conductor (6), and includes a first output transistor (MP3) having a first electrode coupled to a first supply voltage ($V_{DD}$) and a second electrode coupled to the regulated output conductor (6), a second output transistor (MN4) having a first electrode coupled to a second supply voltage ($V_{SS}$) and a second electrode coupled to the regulated output conductor (6), and a cascode transistor (MN3) having a first electrode coupled to a control electrode of the second output transistor (MN4) and a second electrode coupled to a control electrode of the first transistor (MP3). A gain stage (10B) includes a first signal path including the second input (6) and output (3) of the differential input stage (10A), a first follower transistor (MP4) having a first electrode coupled to the regulated output conductor (6), a control electrode coupled to the output (3) of the differential input stage (10A), and a second electrode coupled to a control electrode of the second output transistor (MN4). A second signal path includes a second follower transistor (MP5) having a control electrode coupled to the output (3) of the differential input stage (10A), a first electrode coupled to the regulated output conductor (6), and a second electrode coupled to a second electrode and a control electrode of a first current mirror transistor (MN5) and the control electrode of a second current mirror transistor (MN6). The second current mirror transistor has a second electrode coupled to a control electrode of an amplifying transistor (MN7) having a second electrode coupled to a control electrode of the second output transistor (MN4). First electrodes of the first (MN5) and second (MN6) current mirror transistors and the amplifying transistor (MN8) are coupled to the second supply voltage ($V_{SS}$), a current source (11) being coupled to the control electrode of the second output transistor (MN4). In the described embodiments, the transistors are MOS (metal-oxide-semiconductor) transistors, the first electrodes are sources, the second electrodes are drains, and the control electrodes are gates. In the described embodiments, the output stage (10C) is a class AB output stage.

In the described embodiments, a load (7) is integrated with the voltage regulator circuitry and is coupled to the regulated output conductor (6), wherein the load (7) demands a step change in current supplied to the load.

In one embodiment, the first output transistor (MP3), first follower transistor (MP4), and second follower transistor (MP5) are P-channel transistors and the second output transistor (MN4), cascode transistor (MN3), first current mirror transistor (MN5), second current mirror transistor (MM6), and amplifying transistor (MN7) are N-channel transistors. In a described in bottom, the first (MP4) and second (MN5) follower transistors, the first (MN5) and second (MN6) current mirror transistors, and the amplifying transistor (MN7) are matched transistors. In the described embodiment, a pull-up resistor (R1) is coupled between the control electrode of the first output transistor (MP3) and the first supply voltage ($V_{DD}$).

In one embodiment, the voltage regulator circuitry (10-1) includes a diode-connected transistor (MN8) coupled between the control electrode (17) of the amplifying transistor (MN7) and one terminal of a resistor (R2) having another terminal coupled to the first electrodes of the first (MN5) and second (MN6) current mirror transistors and the amplifying transistor (MN7) for reducing gain of the second signal path to improve stability of the voltage regulator circuitry (10-1).

In one embodiment, the invention provides a method for producing a regulated output voltage (Vout) including controlling the accuracy of the regulated output voltage (Vout) produced by a voltage regulator (10) by applying the regulated output voltage (Vout) to a feedback input (6) of a differential input stage (10A) having a reference voltage (Vref) applied to a reference input of the differential input stage (10A) and applying an output (3) of the differential input stage (10A) to a control electrode of a first follower transistor (MP4) having a first electrode coupled to an input (8) of a class AB output stage (10C) which generates the regulated output voltage (Vout) on an output conductor (6), producing a decrease in the value of the regulated output voltage (Vout) in response to a step increase in load current demand by a load (7) coupled to the output conductor (6), and supplying the load current demanded by the load (7) by applying the decreased value of the regulated output voltage (Vout) during the decrease in value to a first electrode of a second source follower transistor (MP5) having a control electrode coupled to the output (3) of the differential input stage (10A) to decrease current in a current mirror (MN5,6) having an output (17) coupled to a current source (I1) and to a control electrode of an amplifying transistor (MN7), causing the current source (I1) to rapidly turn on the amplifying transistor (MN7) to cause it to rapidly turn on a cascode transistor (MN3) of the class AB output stage, and turning on a first output transistor (MP3) of the class AB output stage (10C) in response to current produced by the cascode transistor (MN3). In one embodiment, the method includes coupling a diode-connected transistor (MN8) between the control electrode (17) of the amplifying transistor (MN7) and one terminal of a resistor (R2) having another terminal coupled to the first electrodes of the first (MN5) and second (MN6) current mirror transistors and the amplifying transistor (MN7) to reduce gain of a signal path including the second source follower transistor (MP5) current mirror (MN5,6), and the amplifying transistor (MM7) to improve stability of the voltage regulator circuitry (10-1).

In one embodiment, the invention provides a voltage regulator (10) for producing a regulated output voltage (Vout) by controlling the accuracy of the regulated output voltage (Vout), including means (6) for applying the regulated output voltage (Vout) to a feedback input of a differential input stage (10A) having a reference voltage (Vref) applied to a reference input of the differential input stage (10A) and means (3) for applying an output of the differential input stage (10A) to a control electrode of a first follower transistor (MP4) having a first electrode coupled to an input (8) of a class AB output stage (10C) which generates the regulated output voltage (Vout) on an output conductor (6), load means (7) coupled to the output conductor (6) for producing a decrease in the value of the regulated output voltage (Vout) in response to a step increase in demanded load current, and circuitry for supplying the load current demanded by the load means (7) including means (6) for applying the decreased value of the regulated output voltage (Vout) during the decrease in value to a first electrode of a second source follower transistor (MP5) having a control electrode coupled to the output (3) of the differential input stage (10A) to decrease current in a current mirror (MN5,6) having an output (17) coupled to a control electrode of an amplifying transistor (MN7), means (I1) for rapidly turning on the amplifying transistor (MN7) to cause it to rapidly turn on a cascode transistor (MN3), and means (12,R1) for turning on a first output transistor (MP3) of the class AB output stage (10C) in response to current produced by the cascode transistor (MN3).

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
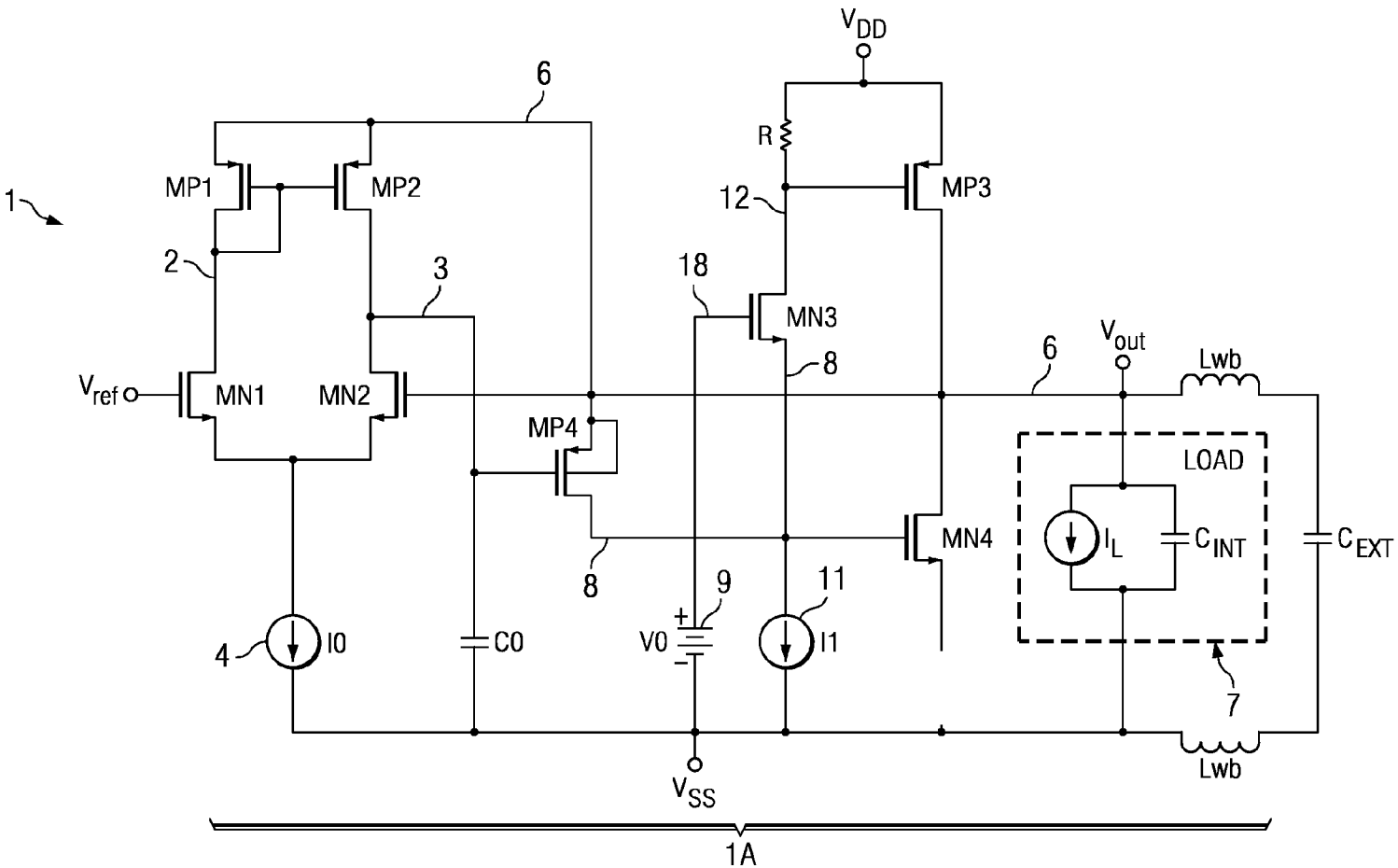
FIG. 1 (PRIOR ART)
FIG. 1 is a schematic diagram of a prior art low-drop voltage regulator circuit.
Figure 2:
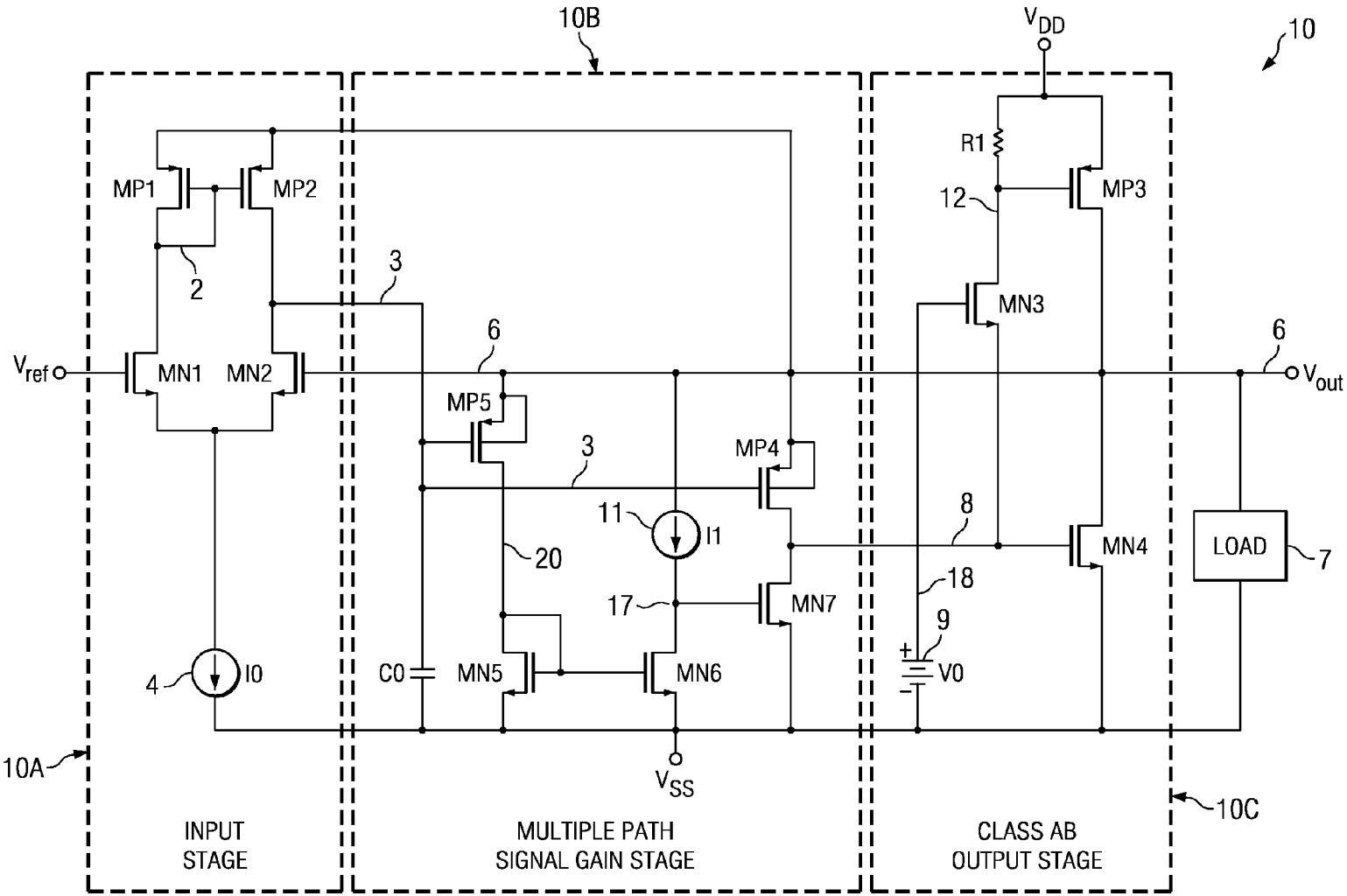
FIG. 2 is a schematic diagram of a low-drop voltage regulator according to the present invention.

FIG. 2 shows an LDO voltage regulator 10 which avoids the above mentioned problems of the prior art. LDO voltage regulator 10. LDO voltage regulator 10 can be embedded in an integrated circuit chip to provide very fast-response load voltage regulation, with reaction times of roughly 1-5 nanoseconds (at the present state-of-the-art), in response to step changes in the amount of current demanded by a load (such as integrated digital logic circuitry) without substantially increasing the power consumption of the LDO voltage regulator and without the need to use a large external load bypass capacitor as required by the prior art voltage regulators. The present invention uses a single gain stage including multiple current gain boost paths, including an additional gain loop to in effect amplify the current I1 of Prior Art FIG. 1 during a step in the demanded load current.

High-speed, low-power LDO voltage regulator 10 includes an input stage 10A including differentially coupled N-channel input transistors MN1 and MN2, P-channel active load transistors MP1 and MP2, and tail current source 4. LDO voltage regulator 10 also includes a class AB output stage 10C including P-channel pass transistor MP3, -channel pull-down transistor MN4, -channel cascode transistor MN3, and voltage source 9 which produces a constant bias voltage V0. Gain stage 10B is coupled between differential input stage 10A and class AB output stage 10C, and includes P-channel source follower transistors MP4 and MP5, -channel current mirror transistors MN5 and MN6, -channel transistor MN7, and constant current source 11 which produces a current I1.

The sources of input transistors MN1 are connected to tail current source 4. The gate of input transistor MN1 is connected to reference voltage Vref, and the gate of input transistor MN2 is connected to regulated output voltage conductor 6 on which the regulated output voltage Vout is produced. The drains of input transistors MN1 and MN2 are connected by conductors 2 and 3 to the drains of active load transistors MP1 and MP2, respectively. The gates of load transistors MP1 and MP2 are connected to conductor 2 and their sources are connected to output conductor 6. (Note that the sources of load transistors MP1 and MP2 could be connected to $V_{DD}$ instead of output conductor 6. And there are numerous other implementations of input stage 10A which could provide satisfactory performance.)

Output conductor 6 also is connected to the drain of pass transistor MP3, the source of which is connected to $V_{DD}$, and to the drain of pull-down transistor MN4, the source of which is connected to $V_{SS}$. As in Prior Art FIG. 1, output conductor 6 also is connected to a load circuit 7 which "demands" a load current that may undergo very fast, large-magnitude transitions. The gate of pass transistor MP3 is connected by conductor 12 to the drain of cascode transistor MN3 and to one terminal of a pull-up resistor R1, the other terminal of which is connected to $V_{DD}$. The source of cascode transistor MN3 is connected by conductor 8 to the gate of pull-down transistor MN4. The gate of cascode transistor MN3 is connected by conductor 18 to receive the bias voltage V0 on the (+) terminal of voltage source 9, the (−) terminal of which is connected to $V_{SS}$.

The source and bulk electrodes of source follower transistors MP4 and MP5 are connected to Vout by means of regulated output conductor 6. Their gates are connected by conductor 3 to the drains of input transistor MN2 and load transistor MP2. The drain of source follower transistor MP5 is connected by conductor 20 to the gate and drain of a current source input transistor MN5, the source of which is connected to $V_{SS}$. The gate of current mirror output transistor MN6 is also connected to conductor 20 and its source is connected to $V_{SS}$. The drain of current mirror output transistor MN6 is connected by conductor 17 to the gate of an amplifying transistor MN7 and to one terminal of current source 11. The other terminal of current source 11 is connected to regulated output voltage conductor 6. The source of amplifying transistor MN7 is connected to $V_{SS}$, and its drain is connected by conductor 8 to the gate of pull-down transistor MN4, the source of cascode transistor MN3, and the drain of source follower transistor MP4. An internal capacitor C0 is connected between conductor 3 and $V_{SS}$.

LDO voltage regulator 10 of FIG. 2 includes three feedback loops. A first "accuracy" feedback loop of voltage regular 10 includes input transistors MN1 and MN2 and source follower transistor MP4. A second feedback loop includes common-gate source follower transistor MP4, pull-down transistor MN4, cascode transistor MN3, and pass transistor MP3. A third feedback loop includes common-gate transistor MP5, current mirror transistors MN5 and MN6, transistor MN7, cascode transistor MN3, and pass transistor MP3.

Internal capacitor C0 provides compensation for the first feedback loop. Capacitor C0 also decreases the bandwidth of the "accuracy" feedback loop including transistors MN1 and MN2 and source follower transistor MP4, thereby decreasing the overall peak-to-peak noise at the output of voltage regulator 10.

In class AB output stage 10C, pull-down transistor MN4 turns off when its gate voltage is sufficiently decreased. The constant bias voltage V0 on conductor 18 causes the current in cascode transistor MN3 to be increased when the voltage on conductor 8 is decreased enough to turn pull-down transistor MN4 off, so as to maintain a minimum current in pull-down transistor MN4. The value of bias voltage V0 and the sizing of cascode transistor MN3 and pull-down transistor MN4 determines the minimum current in pull-down transistor MN4.

If source follower transistors MP4 and MP5 are matched to each other and also to current mirror transistors MN5 and MN6, then the currents through source follower transistors MP5 and MP4 are equal to I1 during constant load conditions. Current through amplifying transistor MN7 is equal to sum of the currents through source follower transistor MP4 and cascode transistor MN3.

Voltage regulator 10 in FIG. 2 differs from the voltage regulator 1 in Prior Art FIG. 1 by including the above mentioned third feedback loop including current mirror transistors MP5, MN5 and MN6 and amplifying transistor MN7. If the load current demanded by load 7 undergoes a large step decrease from, for example, 50 milliamperes to zero, then Vout rapidly increases because load 7 suddenly is not sinking the large current being supplied by pass transistor MP3. That increases the source voltage of source follower transistor MP4, causing it to turn on harder. That causes the gate voltage of pull-down transistor MN4 to rapidly increase. Pull-down transistor MN4 immediately sinks the available charge from capacitance associated with output conductor 6, allowing sufficient time for pass transistor MP3 to decrease its drain current. The rate at which the amplified drain current produced by pass transistor MP3 decreases is determined by its gate capacitance and the resistance of pull-up resistor R1. Thus, voltage regulator 10 of FIG. 2 responds very rapidly to a step decrease in the demanded load current from a large value to a small value.

During a step increase of the current demanded by load 7 from zero to a very high value, a large amount of current must be supplied by pass transistor MP3. That requires the gate voltage of the pass transistor MP3 to rapidly decrease by, for example, a few hundred millivolts. But pass transistor MP3 is a very large device having a very large gate capacitance which may be in the range from roughly 0.5 to 10 picofarads, depending on the application for which LDO voltage regulator 10 is being designed. Thus, a large amount of current must be drawn out of the large gate capacitance of pass transistor MP3. In contrast, in Prior Art FIG. 1 the only current available to be drawn through cascode transistor MN3 from the gate capacitance of pass transistor MP3 is the relatively small current I1, which determines the power consumption of prior art voltage regulator 1 and preferably should not be increased.

The foregoing large step increase in demanded load current causes the regulated output voltage Vout to rapidly decrease. That decreases the currents through source follower transistors MP5 and MP4. The instant that source follower transistor MP5 is turned off, there is no more current flowing into current mirror input transistor MN5 and hence no more current in current mirror output transistor MN6. This allows the constant current I1 to turn transistor MN7 on harder. The increased current through transistor MN7 causes cascode transistor MN3 to turn on harder and increases its drain current to thereby rapidly discharge the large gate capacitance of pass transistor MP3 so as to rapidly turn it on to supply the step increase in the demanded load current.

Figure 3:
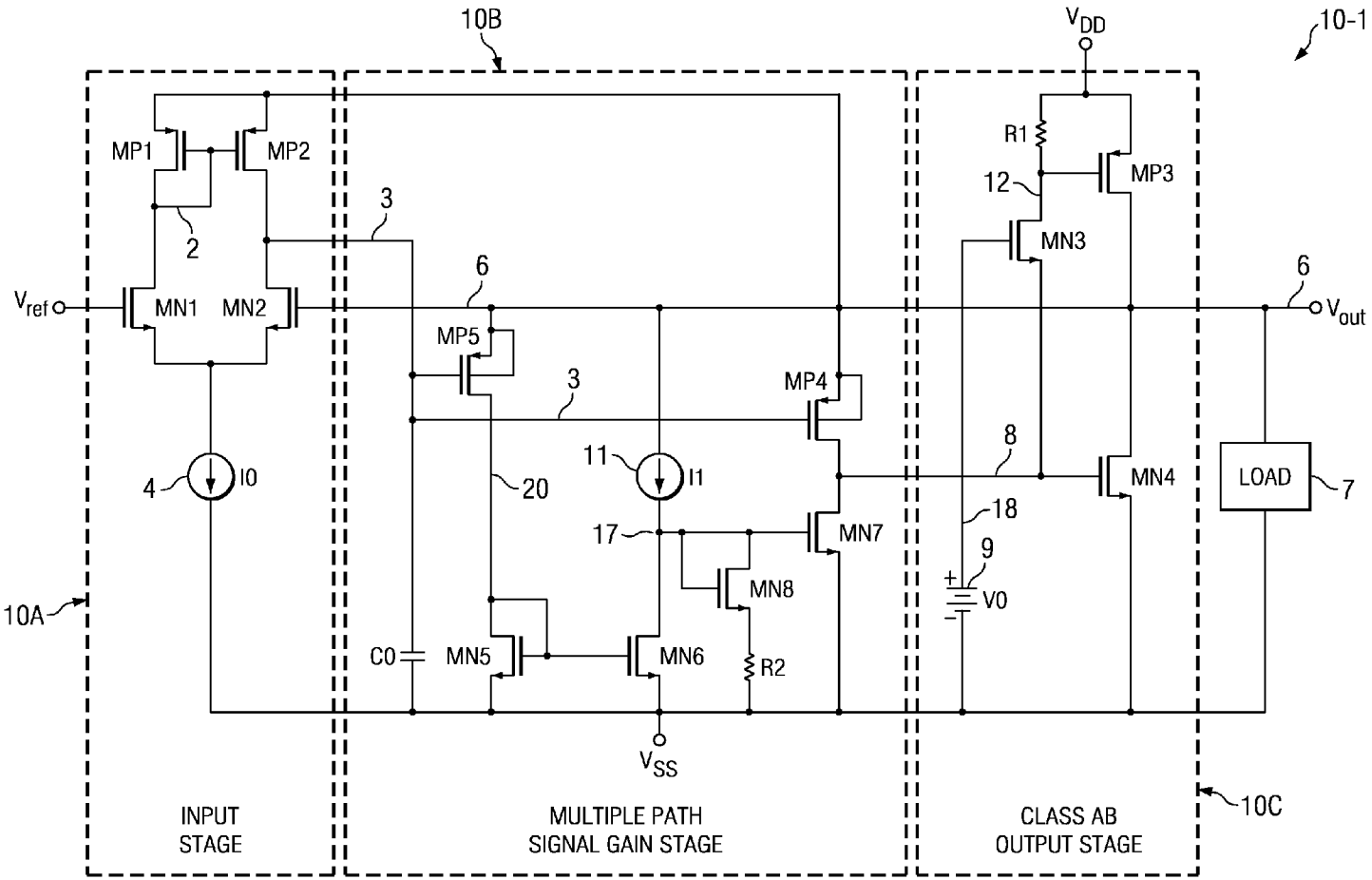
FIG. 3 is a schematic diagram of another low-drop voltage regulator according to the present invention.

In FIG. 2, the feedback loop including source follower transistor MP5, current mirror transistors MN5 and MN6, amplifying transistor MN7, and pull-down transistor MN4 is not always stable. To achieve stability in this feedback loop, diode-connected transistor MN8 is provided with its gate and drain connected to conductor 17 and its source connected to one terminal of a resistor R2 having its other terminal connected to $V_{SS}$, as shown in FIG. 3. This decreases gain in the foregoing feedback loop, thereby achieving improved system stability.

Thus, the previously described problems of LDO voltage regulator 1 of Prior Art FIG. 1 are substantially avoided by the described LDO voltage regulators of the present invention, with parallel paths/feedback loops embedded in the same integrated circuit chip along with digital logic circuitry that is powered by the embedded LDO voltage regulator, which provides nearly instant load regulation for a wide range of load capacitances, without use of the external load bypass capacitor required in Prior Art FIG. 1 and without substantially increasing the power consumption of the LDO voltage regulator.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. Furthermore, the described embodiments are implemented by means of field effect transistors, the invention can be readily implemented using bipolar transistors.

The invention claimed is:

1. An apparatus comprising:

a differential input stage having a first input terminal, a second input terminal, and an output terminal, wherein the first input terminal of the differential input stage receives a reference voltage;

an output stage having an input terminal and an output terminal, wherein the output terminal of the output stage is coupled to the second input terminal of the differential input stage; and a gain stage including:

a first transistor having a first passive electrode, a second passive electrode, and a control electrode, wherein the first passive electrode of the first transistor is coupled to the output terminal of the output stage, and wherein the control electrode of the first transistor is coupled to the output terminal of the differential input stage, and wherein the second passive electrode is coupled to the input terminal of the output stage;

a second transistor having a first passive electrode, a second passive electrode, and a control electrode, wherein the control electrode of the second transistor is coupled to the output terminal of the differential input stage, and wherein the first passive electrode of the second transistor is coupled to the output terminal of the output stage;

a current source that is coupled to the output terminal of the output stage;

a third transistor having a first passive electrode, a second passive electrode, and a control electrode, wherein the first passive electrode of the third transistor is coupled to the input terminal of the output stage, and wherein the control electrode of the third transistor is coupled to the current source; and a current mirror that is coupled to the second passive electrode of the second transistor and the current source.

2. The apparatus of claim 1, wherein the differential input stage further comprises:

a second current mirror that is coupled to the output terminal of the output stage;

a pair of differential input transistors that are each coupled to the current mirror; and a second current source that is coupled to each of the differential input transistors.

3. The apparatus of claim 1, wherein the output stage further comprises:

a fourth transistor having a first passive electrode, a second passive electrode, and a control electrode, wherein the second passive electrode is coupled to the output terminal of the output stage;

a fifth transistor having a first passive electrode, a second passive electrode, and a control electrode, wherein the first passive electrode of the fifth transistor is coupled to the control electrode of the fourth transistor, and wherein the second passive electrode of the fifth transistor is coupled to the input terminal of the output stage;

a sixth transistor having a first passive electrode, a second passive electrode, and a control electrode, wherein the first passive electrode of the sixth transistor is coupled to the output terminal of the output stage, and wherein the control electrode of the sixth transistor is coupled to the input terminal of the output stage; and a voltage source that is coupled to the control electrode of the fifth transistor.

4. The apparatus of claim 1, wherein the gain stage further comprises a diode-connected transistor that is coupled to the control electrode of the third transistor.

* * * * *